United States Patent [19]

De Pas et al.

[11] Patent Number: 4,922,669

[45] Date of Patent: May 8, 1990

[54] MODULAR LATTICEWORK STRUCTURE

[75] Inventors: Jonathan De Pas; Donato D'Urbino; Paolo Lomazzi, all of Milan, Italy

[73] Assignee: Quattrocchio S.r.l., Italy

[21] Appl. No.: 245,774

[22] Filed: Sep. 19, 1988

[30] Foreign Application Priority Data

Sep. 18, 1987 [IT] Italy ..... 310 A/87

[51] Int. Cl.[5] ..... E04H 12/18

[52] U.S. Cl. ..... 52/646; 52/648; 403/171; 403/176

[58] Field of Search ..... 52/646, 645, 648, 81, 52/DIG. 10; 403/171, 173, 174, 176, 177, 178, 217

[56] References Cited

U.S. PATENT DOCUMENTS 4,129,975 12/1978 Gabriel ..... 52/648

4,829,735 5/1989 Zwissler ..... 52/646

*Primary Examiner*—Michael Safavi

*Attorney, Agent, or Firm*—Larson and Taylor

[57] ABSTRACT

In a modular structure consisting of rods and junction plates joined orthogonally to each other, the rods are attached by means of expanding linking pins to tubular coupling hubs provided on the front face of each junction plate at right angles therewith. The latticework rods are attached by means of connecting grippers to an enlarged attachment molding formed along one edge between two orthogonally joined junction plates having complementary beads in the mating flanges of these plates. Thus, from a latticework knot formed by two or more junction plates, rods can be branched off either orthogonal to the plates or inclined relative to the plates.

24 Claims, 7 Drawing Sheets

MODULAR LATTICEWORK STRUCTURE

SUMMARY OF THE INVENTION

The object of the invention is a modular latticework structure that consists of rods forming any suitable bidimensional or tridimensional framework, and being mutually connected at the structure knots by means of junction plates peripherally provided with inclined flanges at an angle of 45°, and which by their flanges being set in mating relation, can be orthogonally joined and connected by means of screws.

A modular latticework structure of this type is known from the document EP-A-No. 0 079 314. In this known embodiment, the latticework rods have flattened ends which by means of bolts are fastened directly to the junction plate flanges. When it is the case of knots formed by two or more junction plates, the flattened ends of the rods are preferably fitted and clamped between two cooperating flanges. By this known construction a limit is set to the directions in which the rods may be branched off from a knot consisting of one or more junction plates, so that the potential design of the latticework structure is also restricted. Moreover, the fastening strength of the rods to a junction plate or to junction plates often is unsufficient, while their assembly and disassembly is uneasy and requires a relatively long time.

The invention aims to eliminate the drawbacks as encountered in the known modular latticework structures of the type as described in the preamble, and consists in the combination of the following features:

(a) each junction plate has at least one coupling hub projecting from one face of the plate, perpendicularly to the plane thereof, and allowing to removably fasten at least one latticework rod;

(b) the flanges in each junction plate are inclined relative to the plane of the plate, toward the plate face from which there projects the said at least one coupling hub;

(c) the free edges of the flanges in each junction plate are formed with a bead projecting from that side of a flange which is turned toward one coupling hub and extending over at least part of the flange length, whereby an enlarged attachment molding is formed between this bead and the corresponding opposite bead in the mating flange of another junction plate, at the outward formed by edge the two plates;

(d) connecting grippers are provided, which are adapted for removably clamping the said enlarged attachment molding formed along the outward edge between two orthogonally joined junction plates, the free end of each connecting gripper being provided with means for removably fastening at least one latticework rod.

In the latticework structure according to the invention, from a knot consisting, for example, of two orthogonally arranged plates, rods to be fastened to the coupling hubs on the outward faces of these plates, can be branched off perpendicularly to the planes in which the said plates lie, or rods to be fastened by means of connecting grippers to the enlarged attachment molding as above disclosed, can be branched off at any suitable angle of inclination.

When it is the case of a knot consisting of six junction plates so joined as to make up a cube, from each face of the cube at least one rod to be fastened to a coupling hub on the respective junction plate, can be branched off orthogonally to the respective face of the cube, and from each one of the cube edges at least one rod to be fastened by means of a connecting gripper to the respective enlarged attachment molding, can be branched off at any suitable angle of inclination.

Preferably, in an advantageous embodiment of the invention, the junction plate is formed with a plurality of hubs arranged in an angularly equispaced relation around the centre of the plate.

The removable fastening of the latticework rods to the coupling hubs in the junction plates and to the free ends of the connecting grippers clamped on an enlarged attachment molding, may be attained in any suitable manner. Thus, for example, either the ends of the latticework rods or the coupling hubs on the junction plates may be given a tubular shape, and may be interconnected by fitting the said rod ends on or into the coupling hubs.

Preferably, however, according to a particularly advantageous embodiment of the invention, both the ends of the latticework rods and the coupling hubs projecting from the junction plates are given a tubular shape, and the connection of the rods to the hubs is made by means of expanding linking pins which are partly fitted into the tubular end of a rod and partly into a tubular coupling hub, and which can be radially expanded by means of at least one transversal opening-out screw provided in correspondence of an intermediate collar on the pin.

Also the connecting grippers may be made and operated in any suitable manner. In an advantageous embodiment of the invention, each connecting gripper consists of two opposing concavely shaped jaws which are adapted for clamping with the aid of at least one clamp screw, the enlarged attachment molding formed at the edge between two orthogonally arranged junction plates, the said jaws being formed with juxtaposed complementary linking half-pin extensions which between them form an expanding linking pin on which the tubular end of a latticework rod can be engaged. The said linking pin can be radially expanded by means of at least one transversal opening-out screw acting between the linking half-pin extensions of the two jaws.

According to one preferred embodiment of the invention, in order to keep separate and make mutually independent the clamping action on the enlarged attachment molding of the two connecting gripper's jaws, and the transversally opening-out action of the juxtaposed linking half-pin extensions of said jaws, the linking half-pin extension of at least one connecting gripper's jaw is made as a discrete piece and is connected with the respective jaw with the aid of joint-like fitted means allowing a small relative movement between the jaw and its linking half-pin extension.

Further advantageous embodiments of the invention form the object of the other dependent claims.

BRIEF DESCRIPTION OF THE DRAWINGS

Some embodiments of the invention are shown in the accompanying dawings, in which.

DESCRIPTION OF THE PREFERRED EMBODIMENTS

Figure 5:
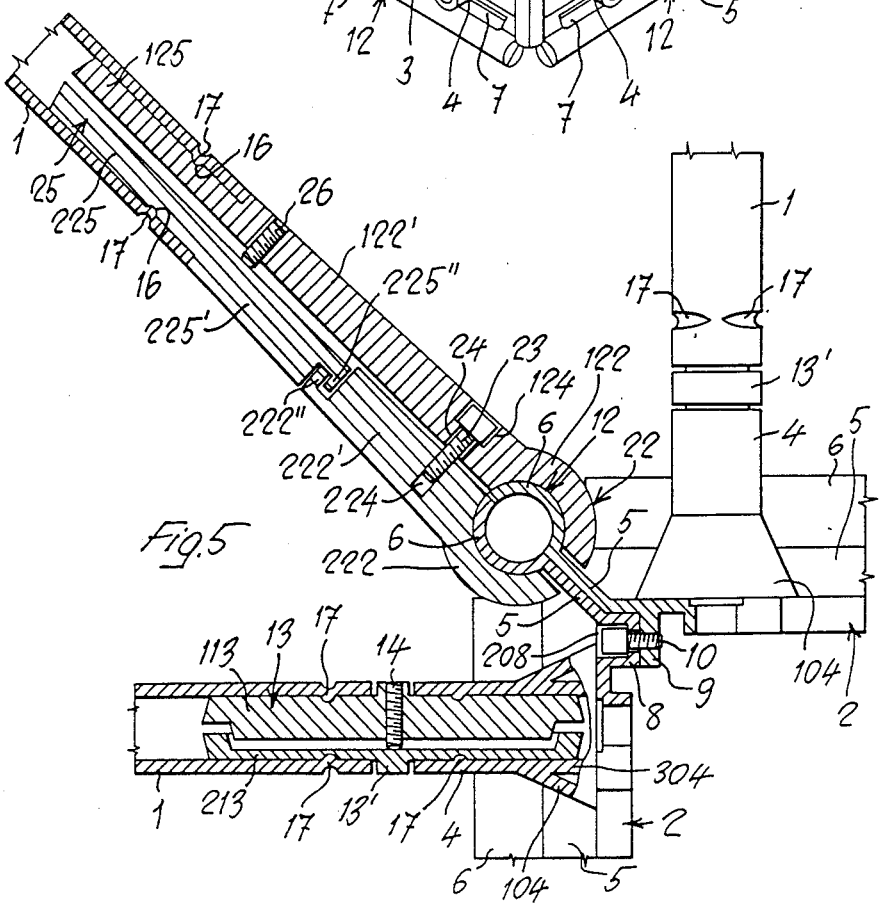
FIG. 5 is a sectional view in an enlarged scale through an edge between two junction plates in the cube-like knot according to FIG. 4, with a connecting gripper being clamped on the enlarged attachment molding in the said edge, and with tubular rods being connected by means of expanding-pin joints to the coupling hubs in the two junction plates.
Figure 19:
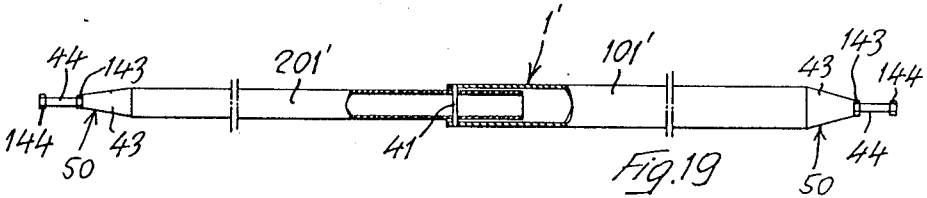
FIG. 19 is a partly sectional view showing a telescopic rod for the latticework structure according to the invention.

Referring to the drawings, the invention provides a modular latticework structure mainly consisting of rods 1, 1' and junction plates 2. The rods 1, 1' may be separate simple rods, as shown in FIG. 5 and in the left-hand side of FIG. 6, and also in FIGS. 16 and 19, or they may be transversely interconnected in such a manner that beams are formed, which consist each of two or more parallel rods 1, as shown in the right-hand side of FIG. 6.

Each junction plate 2 preferably is square in shape, and is formed with a wide circular opening S in its centre, which is useful for manually holding the said plate 2. From one face (that will be called "front face" hereinafter) of the junction plate 2 there project four tubular coupling hubs 4 arranged in an angularly equispaced relation around the central opening 3, and preferably located in the four corner zones of plate 2. Each tubular coupling hub 4 is substantially cylindrical, and stands at right angles to the plane of the junction plate 2, and is connected to the front face of said plate through a truncated cone-shaped base portion 104. At the interior of the said truncated cone-shaped base portion 104, each coupling hub 4 is formed with a cylindrical tubular extension 304 substantially reaching to the back face of plate 2, which is opposite to the face from which the hub 4 projects, as it clearly appears particularly from FIGS. 5, 16 and 18.

The bore 204 in each coupling hub 4 is a cylindrical through bore which continues also through the internal extension 304 of said hub 4.

The junction plate 2 is peripherally formed at its four sides with flanges 5 which are inclined by 45° toward the front face of plate 2, i.e., toward the face from which the coupling hubs 4 project. Each flange 5 is provided on its side turned toward the front face of plate 2, i.e., toward the coupling hubs 4, with a projecting, substantially semi-cylindrical bead formed in correspondence of the flange free edge, and which may even be a hollow bead.

Additionally, each flange 5 has one or more slots 7 which are suitably provided lengthwise of the respective side of a junction plate 2. These slots may extend also in correspondence of the bead 6.

Figure 3:
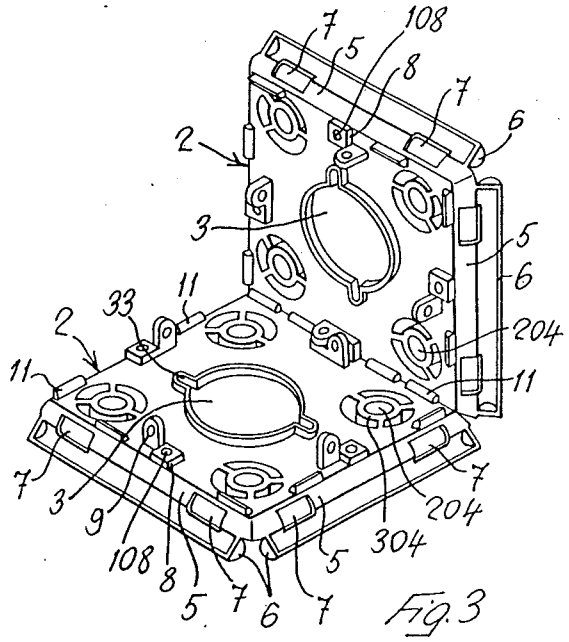
FIG. 3 is a perspective view showing a knot of the modular latticework structure according to the invention, which is formed by two orthogonally joined junction plates according to FIGS. 1 and 2.
Figure 1:
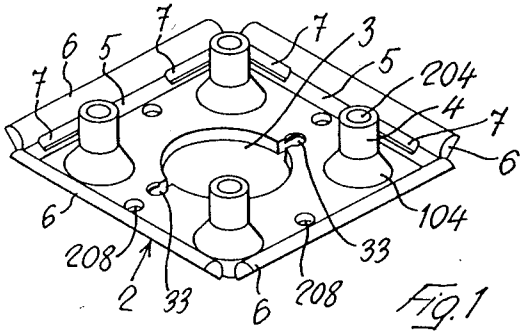
FIGS. 1 and 2 are perspective views respectively showing one of the two opposite faces of a junction plate adapted for modular latticework structures according to the invention.
Figure 2:
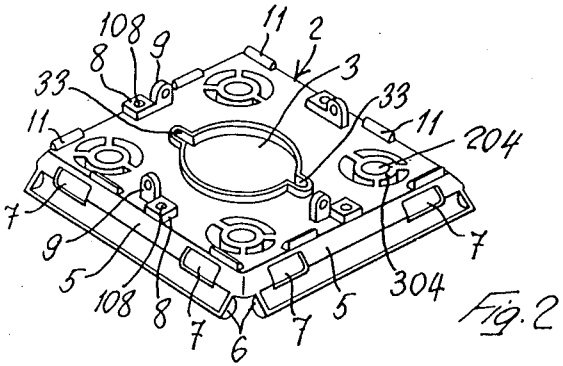

Two junction plates can be orthogonally joined each other by one of their sides, by setting the respective flanges 5 in mating relation, as shown particularly in FIGS. 3 and 5. These two junction plates are fastened to each other by means of screws. To this end, on the rear face of each junction plate 2 a boss B with a bore 108 therein is provided at each side of the plate, the said bore 108 becoming wider and forming a countersink 208 on the front face of plate 2, as it appears particularly from FIGS. 1, 2, 3, 5 and 17. Beside the said boss 8, an ear 9 with a threaded bore therein is provided on the back face of plate 2, in a position a little away from the respective edge of the junction plate 2.

The pairs formed by a boss 8 and an ear 9 are so arranged and oriented that when two junction plates 2 are orthogonally joined to each other, the ear 9 of the one plate 2 is placed upon the boss B of the other plate, as it particularly appears from FIGS. 3 and 5. The two junction plates 2 can then be removably fastened to each other by means of screws 10 which from the outward face of each plate 2 are each threaded through the bore 108 in the respective boss 8, and are screwed down into the threaded bore in the ear 9 of the other plate 2, as it clearly appears particularly from FIG. 5. The head of each screw 10 is accomodated and embedded in the counersink 208 of the bore 108 in boss 8.

On the back face of a junction plate 2, projecting abutment members 11 are provided along each side of said plate, and are so arranged that when two junction plates 2 are orthogonally joined to each other, the projecting abutment members 11 in the one plate 2 will be in an offset relation with the projecting abutment members 11 in the other plate 2, and will cooperate with the back planar face thereof. The projecting abutment members 11 thus afford an easy and proper alignment and positioning of the two orthogonally joined junction plates 2 with respect to each other, and even bring about, along with the bosses 8 and the ears 9, an interlocking effect between the said plates 2.

When two junction plates 2 are orthogonally joined to each other as disclosed above, the semi-cylindrical beads 6 provided at the free edge of the flanges 5 set in mating relation, become mutually integrated, so that they form a substantially cylindrical, may be hollow, enlarged attachment molding 12. This cylindrical attachment molding 12 extends along the outward edge formed by two orthogonally joined junction plates 2, and is connected to said plates by the two mating flanges 5, with their slots 7 being in a coinciding relation, as shown particularly in FIGS. 4, 5 and 6.

The above disclosed junction plates 2 according to the invention, are preferably made of a light alloy, particularly die-cast aluminum.

Figure 4:
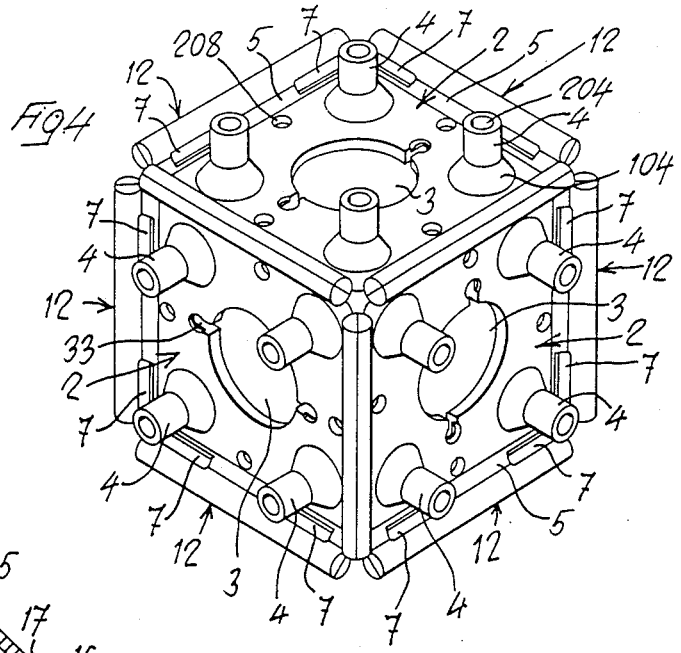
FIG. 4 is a perspective view showing a knot of the modular latticework structure according to the invention, which is formed by six junction plates according to FIGS. 1 and 2, so joined as to make up a cube.
Figure 6:
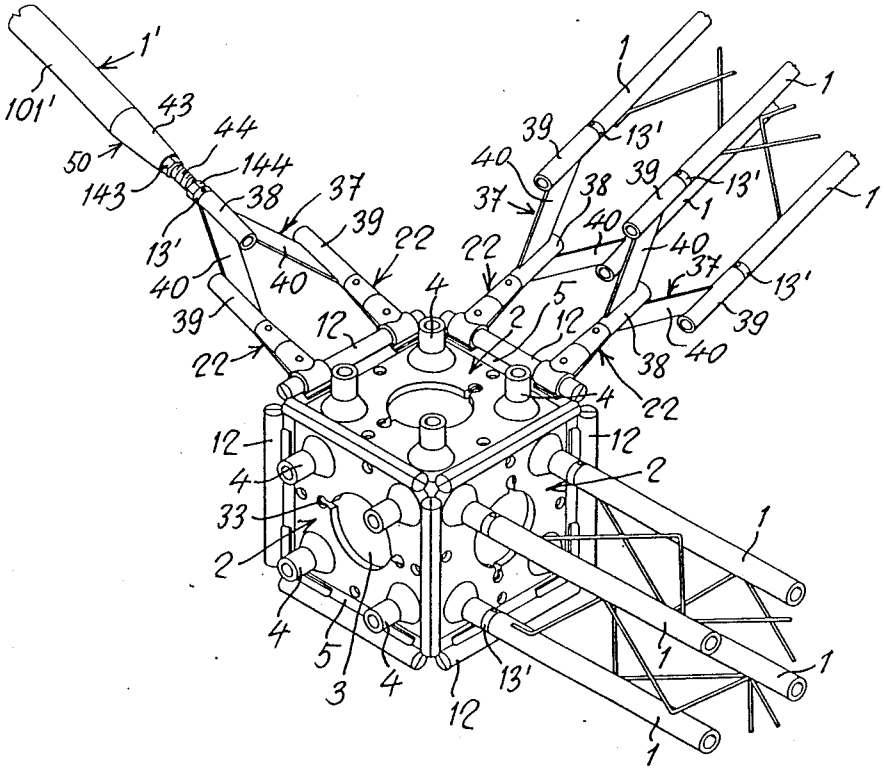
FIG. 6 is a perspective view showing a cube-like knot according to FIG. 4, with latticework rods and beams being connected therewith.
Figure 7:
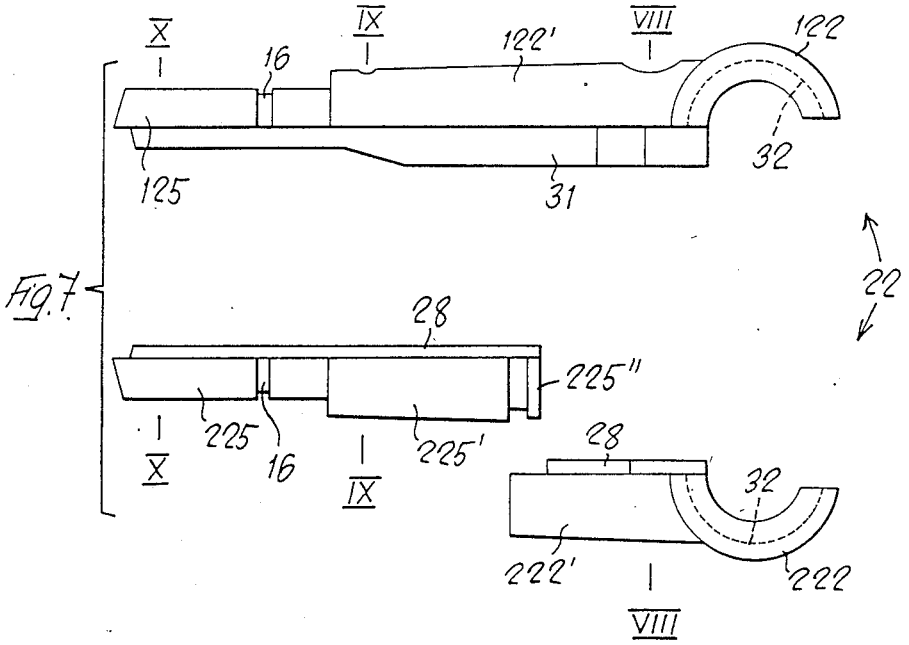
FIG. 7 is an exploded side view showing the several components of a connecting gripper.

For constructing a modular latticework structure according to the invention, simple junction plates 2 can be used, as it will be disclosed later on by referring to FIGS. 16 to 18, or knots can be used, consisting of two or more junction plates 2, which are joined to each other and are fastened as stated above. A knot formed by two orthogonally joined junction plates 2 is shown in FIG. 3, while FIGS. 4 and 6 show a knot consisting of six junction plates 2 which are so joined as to make up a cube.

It is apparent that knots consisting of three, four, or five junction plates, can be also made.

From each one of these knots, just as from only one junction plate 2 as well, one or more rods 1 to be each removably fastened directly to a coupling hub 4, can be branched off and oriented orthogonally to the junction plate or plates 2. For this purpose, at least the ends of rods 1 are given a tubular shape, and expanding linking pins 13 are provided, which are formed with a projecting median collar 13' and consist each of two complementary half pins 113 and 213, as shown particularly in FIGS. 5, and 13 to 16. Each linking pin 13 can be expanded, i.e. radially opened out, by means of an opening-out screw 14 which in correspondence of the collar 13' is screwed into a threaded bore 15 provided in one of the half-pins (the 113), and is pressed against the other half-pin 213. In order to have a rod 1 connected to a coupling hub 4 in a junction plate 2, the linking pin 13 in not expanded condition is fitted into the tubular coupling hub 4 as far as its collar 13' and the rod 1 is engaged on the remaining half of the expanding pin 13 as far as the collar thereof, whereupon the linking pin 13 is expanded, i.e. radially opened out, by screwing down the opening-out screw 14 until the linking pin 13 becomes firmly blocked both in the coupling hub 4 and in the rod 1.

The outer cylindrical surface of the linking pin 13 may be smooth. Also the two facing surfaces of the two half-pins 113, 213 may be planar and smooth.

However, according to a particularly advantageous embodiment of the invention, the expanding linking pin 13 may be formed in each of its sections at either sides of the median collar 13', with an annular groove 16 associated with a matching inwardly projecting annular member 17 provided at the interior of a tubular coupling hub 4 and the tubular end of rod 1. Initially, when the not yet expanded linking pin 13 still is of a reduced diameter, this pin can be easily fitted into a coupling hub 4 and into the end of rod 1, by causing its external annular grooves 16 to coincide with the inwardly projecting annular members 17 in hub 4 and in rod 1. Thereafter, when the linking pin 13 has been expanded by means of an opening-out screw 14, the projecting annular members 17 in hub 4 and in rod 1 become engaged in the respective external annular grooves 16 in the linking pin 13. Thus, the expanding linking pin 13 is interlockingly connected with the rod 1 and the coupling hub 4, whereby a junction is provided therebetween which affords a higher resistance to any axial forces.

The projecting annular members 17 in the tubular hub 4 and/or in the tubular rod 1 may be discontinuous and/or incomplete, i.e., they may extend over an angle smaller than 360°, which facilitates their manufacturing. Thus, for example, each inwardly projecting annular member 17 may be formed by two diametrically opposite sectors, extending each over an angle smaller than 180°, which are obtained by crushing and deforming the tubular hub 4 or the tubular end of rod 1 with suitable pliers, or the like, as shown in the right-hand side of FIG. 5.

Preferably, the facing inner surfaces of the two half pins 113, 213 composing an expanding linking pin 13, are provided with complementary projections and recesses which are interengaged so as to obtain a positive interlocking between the two half-pins 113, 213 whereby any relative axial and transversal displacement between the two half-pins 113, 213 is prevented.

Figure 14:
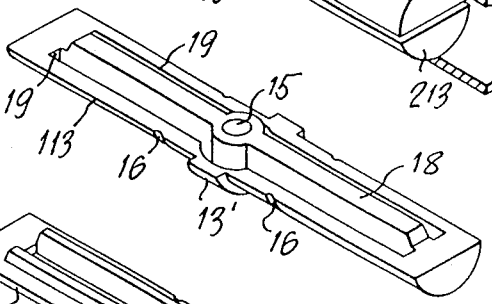
FIGS. 14 and 15 are perspective views respectively showing the two halves (half-pins) of the expanding pin according to FIG. 13.
Figure 15:
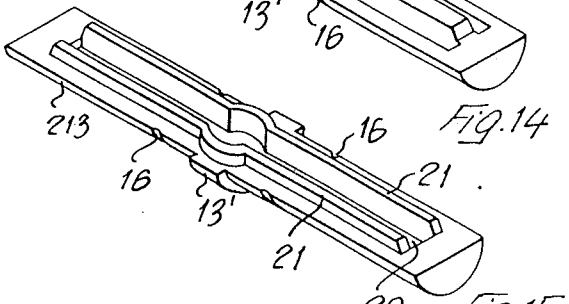
Figure 11:
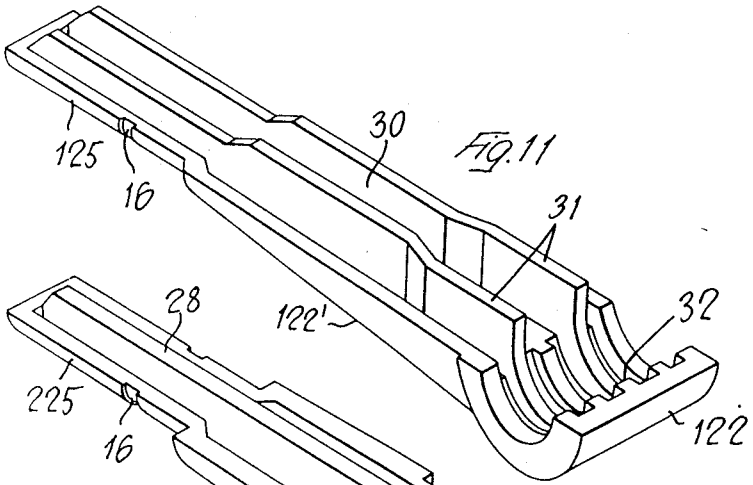
FIGS. 11 and 12 are perspective views showing the components of the connecting gripper according to FIGS. 7 to 10.
Figure 12:
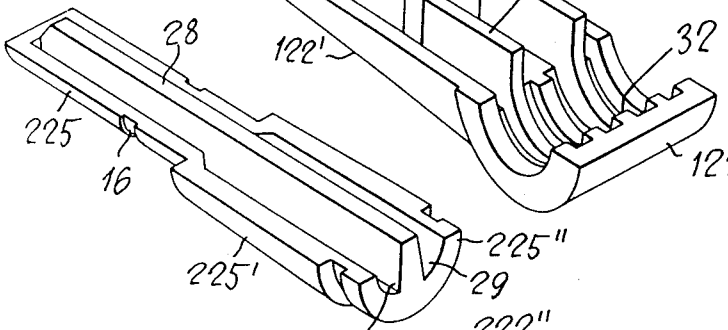
Figure 12:
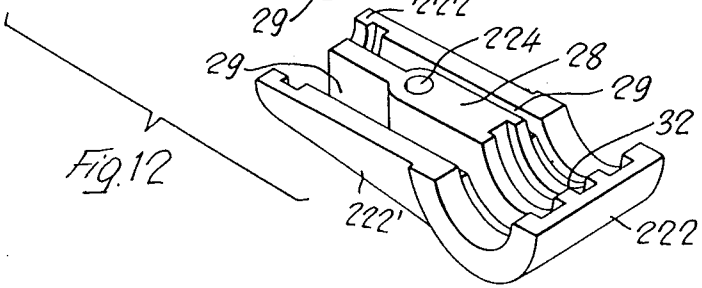

For this purpose, in the embodiment shown in FIGS. 14 and 15, the inner surface of the half-pin 113 which is turned toward the other half-pin 213, is provided with a longitudinal rib 18 having an enlarged cylindrical portion in correspondence of the bore 15 and having longitudinal grooves 19 formed at both sides of said rib 18. Both the rib 18 and the grooves 19 at the sides of this rib, terminate at a distance from the ends of the half-pin 113.

The inner surface of the other half-pin 213, which is turned toward the half-pin 113, is formed with a longitudinal, intermediately widened groove 20 in which the rib 18 of the half-pin 113 is engaged. At both sides of the groove 20, the inner surface of the half-pin 213 is formed with two longitudinal ribs 21 which are engaged in the two grooves 19 of the other half-pin 213. Also the grooves 20 and the ribs 21 of the half-pin 213 terminate at a distance from the ends of said half-pin 213.

From each knot consisting of two or more orthogonally joined junction plates 2, one or more rods 1 can be also branched off at any suitable angle of inclination.

Figure 8:
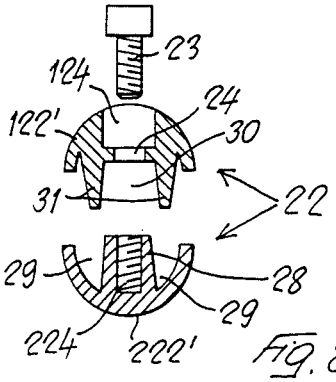
FIGS. 8, 9 and 10 are cross-sectional views of the connecting gripper, respectively taken on lines VIII—VIII, IX—IX and X—X in FIG. 7.
Figure 9:
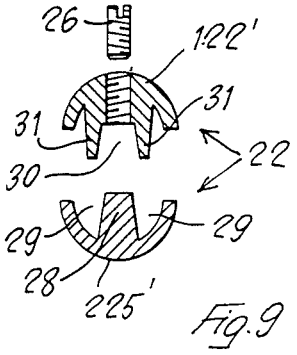
Figure 10:
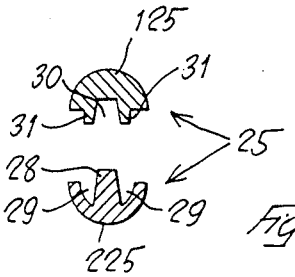
Figure 13:
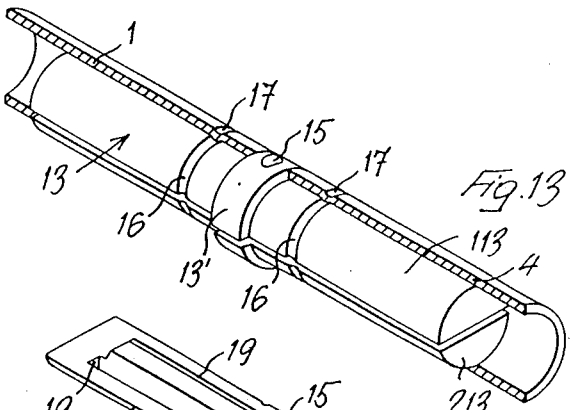
FIG. 13 is a perspective view showing an expanding-pin joint between two tubular members of the modular latticework structure according to the invention.

For this purpose, the invention provides connecting grippers 22 which are capable to clamp by one of their ends the cylindrical attachment molding 12 formed at the outward edge between two junction plates 2, the other end of said grippers being so made as to permit a removable fastening of a latticework rod 1. In one preferred embodiment of the invention, each connecting gripper 22 consists of two concavely shaped jaws 122 and 222 which are adapted for enclosing therebetween the said cylindrical attachment molding 12 and for being tightly clamped thereon by means of at least one clamp screw 23 which is passed through a bore 24 provided in the shank 122' of the one jaw 122, and is screwed in a threaded bore 224 provided in the shank 222' of the other jaw 222, as shown particularly in FIGS. 5 and 8. The head of screw 23 is preferably received in a matching countersink 124 of bore 24. The shank 122' of the jaw 122 is made of one piece with a linking half-pin extension 125, which is like or similar to one of the half-pins 113, 213 of an expanding linking pin 13 of the type as stated above. Associated with this linking half-pin extension 125 of the shank 122' of jaw 122 is a linking complementary half-pin 225 which instead of being made of one piece with the shank 222', of the respective jaw 222, is made as a separate piece and has a rearward extension 225' whereby it is interlockingly connected in a slightly movable manner with the shank 222' of said jaw 222.

More particularly, as it clearly appears in FIG. 5, the rearward extension 225' of the half-pin 225, which is the prolongation of the shank 222' of the jaw 222, ends with a hook portion 225" to be engaged with a hook portion 222" at the end of the shank 222' of the jaw 222. The engagement between the two hook portions 222" and 225" gives rise to a sort of limited articulation between the shank 222' of the jaw 222 and the half-pin 225 which is associated therewith. Threaded transversely through the shank 122' of the jaw 122, which is integral with the linking half-pin 125, is an opening-out screw 26 which is screwed and pressed against the rearward extension 225' of the linking half-pin 225 associated with the shank 222' of the other jaw 222.

The two half-pins 125, 225 are set in a juxtaposed relation, and are substantially semi-cylindrical in shape, so that they form between them an expanding cylindrical linking pin 25 which is similar to the above-disclosed expanding linking pin 13, but is not self-standing, and forms the free end of a connecting gripper. The rod 1 to be connected with the connecting gripper 22 is engaged by its tubular end on the said linking pin 25 and is removably fastened thereto when the linking pin 25 has been expanded, i.e., radially opened out by means of the opening-out screw 26.

Thanks to the half-pin 25 being allowed a limited displacement relative to the associated jaw 222, which is obtained by making the half-pin 225 separately from the jaw 222 and by causing this half-pin and this jaw to be mutually engaged, it is possible to act separately on the jaws 122, 222 and on the linking half-pin 25, without these jaws and this pin being reciprocally affected, so as to clamp the jaws 122, 222 on the attachment molding 12 by means of the clamping screw 24, and as to expand the linking pin 25 by means of the opening-out screw 26, notwithstanding that the expanding linking pin 25 forms an integral part of the connecting gripper 22.

Of course, also the expanding linking pin 25 of the connecting gripper 22 may be provided with an external annular groove 16 in which an inwardly projecting annular member 17 at the interior of rod 1 is engaged in the expanded condition of said pin 25, similarly to what has been disclosed above in connection with the linking pin 13.

The facing inner surfaces of the shanks 122' and 222' of the two jaws 122 and 222 of the connecting gripper 22 and/or the corresponding inner surfaces of the half-pins 125 and 225, 225' of the expanding linking pin 25 of said gripper, may be planar and smooth or, similarly to the linking pin 13, they may be provided with complementary projections and recesses which are interlockingly fitted the one in the other, and which substantially prevent any relative axial or transversal displacement of the two jaws 122 and 222.

For this purpose, in the embodiment shown in FIGS. 7 to 12, the single-piece half of a gripper 22, which comprises the jaw 122, its shank 122' and the linking half-pin 125, is formed with a longitudinal median groove 30 which is provided on both sides with a respective longitudinal rib 31.

The other half of two pieces of a gripper 22, which comprises the jaw 222 and its shank 222', and also the linking half-pin 225 and its rearward extension 225' is formed with a longitudinal median rib 28 and with a respective longitudinal groove 20 at both sides thereof. When the gripper 22 is in assembled condition, the rib 28 on the one half of the gripper is fitted in the groove 30 in the other half of the gripper, while the two ribs 31 are engaged in the grooves 29. Moreover, the two jaws 122, 222 are provided with an internal transverse toothing 32, as shown particularly in FIGS. 11 and 12.

The slots 7 in the flanges 5 of the junction plates 2 are each of such a width that is at least a little greater than the width of the jaws 122, 222 of a connecting gripper 22. Therefore, when a connecting gripper 22 is applied in correspondence of the coinciding slots 7 in the two mating flanges 5, to the cylindrical attachment molding 12, then the gripper 22 can be swung about the cylindrical attachment molding 12 and can be caused to assume any suitable orientation over an angle of at least 90°, since its jaws 122, 222 get into the slots 7.

Figure 16:
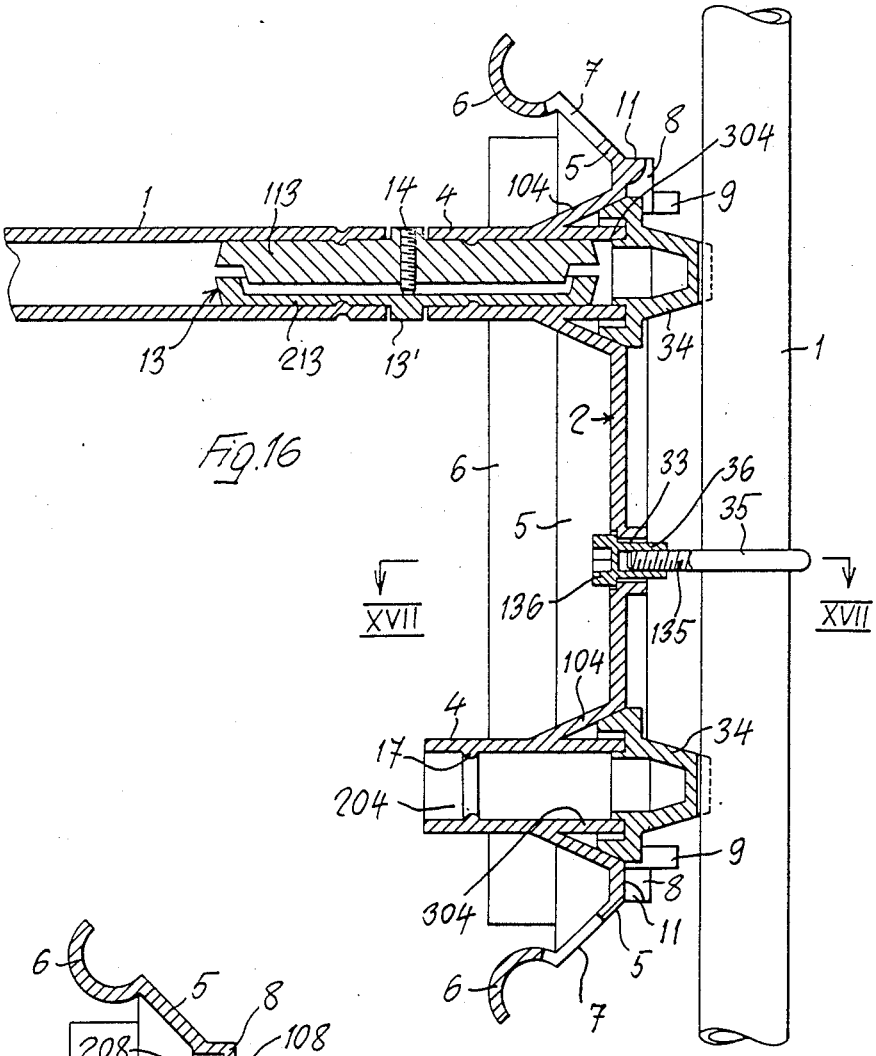
FIG. 16 is a sectional view showing how a junction plate is fastened to a beam of the modular latticework structure according to the invention.
Figure 17:
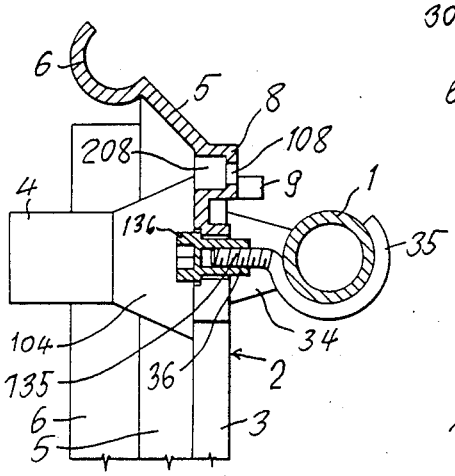
FIG. 17 is a partial sectional view taken on line XVII—XVII in FIG. 16.

In FIGS. 16 and 17 there is shown how a junction plate 2 can be applied to two rods 1 of a latticework beam formed either by four or by two parallel rods 1, of the type as shown in FIG. 6. For this purpose, around the central opening 3 in each junction plate 2, at least two diametrically opposite through bores 33 are provided in this plate, which through respective slots extending from their cut rim, are set in communication with the said central opening 3.

Mounted on the back face of the junction plate 2 are four bearing spacer feet 34 which are each engaged in the rear end of the internal extension 304 of a tubular coupling hub 4 and in the surrounding cavity in the respective truncated cone-shaped base portion 104, and are each formed with a cylindrical sector groove in their opposite free end. By means of these inserted spacer feet 34, the junction plate 2 is caused to bear against the two rods 1 of the latticework beam, and is pressed against, and fastened to these rods 1 by means of two anchoring hooks 35 which are respectively engaged on one of the said rods 1. Each hook 35 has a threaded shank 135 which is screwed into a threaded bushing 36 rotatably received in one of the bores 33. This bushing 36 is formed with a head 136 bearing against the front face of the junction plate 2. When the threaded bushings 36 are turned by their heads 136 so as to screw and draw down the respective hooks 5 which bear against bearing spacer feet 34. As shown in FIG. 17, spacer feet 34 has two ends, with a shape at one end that is complementary to junction plate 2 against which the spacer feet end engages, and is complementary at its other end to rod 1 which, as shown in FIG. 17, engages with the other end of the spacer feet. As the respective hooks 35 are drawn down by the turning of threaded bushings 36, the junction plate 2 is pressed against, and clamped on the two rods 1 of the latticework beam.

The modular latticework structure according to the invention, furthermore comprises Y-shaped connection members 37 consisting of a sleeve 38 to which two other spaced apart sleeves 39 which are parallel to each other and to the sleeve 38, are fixedly connected by means of two diverging limbs 40, as shown in FIG. 6. This Y-shaped connection member 37 can be used in a variety of ways in a modular latticework structure according to the invention. Thus, as a possible application of the Y-shaped connection member 37, in the left-hand side of FIG. 6 there is shown merely by way of an example, the fastening of an inclined rod 1' of the latticework structure to a cylindrical attachment molding 12 in a latticework knot, by means of two connecting grippers 22. In this instance, the Y-shaped connection member 37 is attached by means of its two sleeves 39 to the ends in form of expanding linking-pins 25 of two connecting grippers 22 which clamp the attachment molding 12 in correspondence of the slots 7, while the rod 1' is attached to the third sleeve 38 of the Y-shaped connection member 37 by means of an expanding linking pin 13, of which only the collar 13′ is visible. In the right-hand upper side of FIG. 6 a further application of the said connection member is shown, where a latticework beam consisting of four connected parallel rods 1, is fastened to a cylindrical attachment molding 12 in a latticework knot by means of two connecting grippers 22 which clamp the said molding, and by means of two Y-shaped connection members 37 which by their sleeves 38 are engaged on, and fastened to the ends in form of linking pins 25 of the grippers 22, while the four rods 1 of the beam are attached to the opposite sleeves 39 of said members 37, by means of expanding linking pins 13, of which only the collars 13′ are visible.

Besides the simple rods 1, the modular latticework structure according to the invention may also comprise telescopic rods 1′ which are particularly adapted for forming the inclined or diagonal rods of a latticework. A telescopic rod 1′ consists of two tubular members 101′ and 201′ which are slidably telescoped the one within the other, and which are lockable to each other at the required length of a telescopic rod 1′, by means of a transversal pin 41 fitted into coinciding bores in the two tubular members 101′, 201′, as shown particularly in FIGS. 19 and 20. Apart from such a relatively rough adjustment in length of a telescopic rod 1′, a closer and even micrometric adjustment of said rod length may be attained by providing at least one end of the telescopic rod 1′ with a screw-adjustable spacer device 50.

Figure 20:
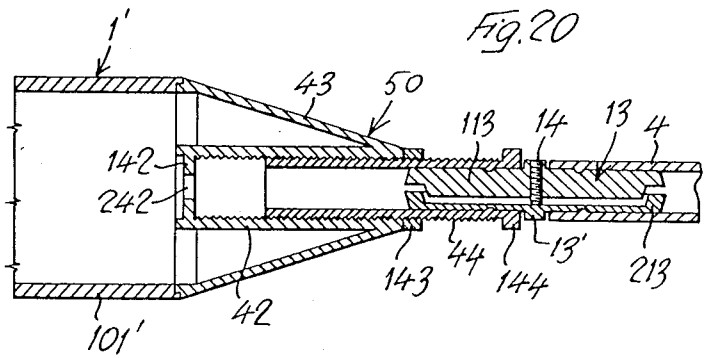
FIG. 20 is a longitudinal sectional view in an enlarged scale showing one end of the telescopic rod according to FIG. 19, which is connected with a tubular member of the latticework structure.

Shown in FIG. 20 is one preferred embodiment of the said screw-adjustable spacer device 50, which may be used also for a number of other purposes in the modular latticework structure according to the invention. This adjustable spacer device 50 consists of a truncated cone-shaped base member 43 integral with a threaded bushing 42 which is provided at the interior of the base member 43, co-axially thereto.

The threaded bushing 42 has one end opening on the small end of the truncated cone-shaped base member 43, and has its opposite end extending substantially up to be flush with the large end of said base member 43, where the threaded bushing 42 is provided with a disc 142 having a central opening therein.

Screwed in the open end of the threaded bushing 42 is a sleeve 44 which is provided with an external thread and projects axially from the small end of the truncated cone-shaped base member 43. The outward end 144 of the said threaded sleeve 44 is given a polygonal shape, such as to be engaged by a wrench. Also the corresponding small end 143 of the truncated cone-shaped base member 43 is given a polygonal shape, so as to facilitate the screwing down and the screwing out of the threaded sleeve 44.

For adjusting the length of a telescopic rod 1′, the truncated cone-shaped base member 43 is applied to one end of said telescopic rod 1′, for example, by engaging the large end of the base member 43 in or on the tubular telescopic rod end, as shown in FIG. 20. The length of rod 1′ is changed and adjusted by more or less screwing down or out the threaded sleeve 44, thus causing it to more or less project out from the respective rod end. The connection of this end of a telescopic rod 1′ with a tubular coupling hub 4 in a junction plate 2 is made by means of an expanding linking pin 13 which is inserted into the sleeve 44, as shown in FIG. 20. In a similar manner, a telescopic rod 1′ can be coupled with a connecting gripper 22 by fitting the end in form of an expanding linking pin 25 of said gripper into the sleeve 44.

Of course, the above-disclosed screw-adjustable spacer device 50 can be also applied to at least one end of a normal, i.e., not telescopic rod 1.

Figure 18:
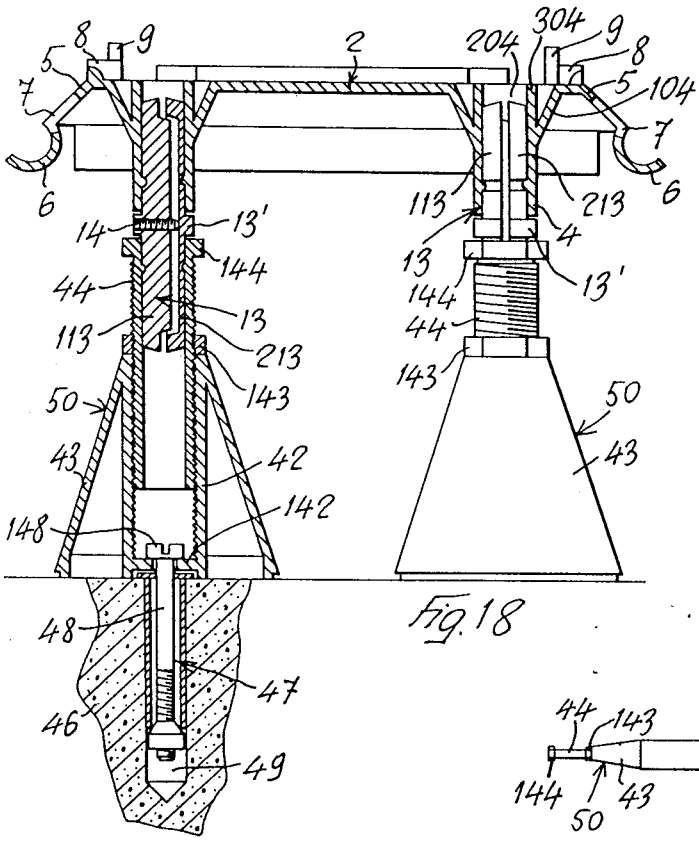
FIG. 18 is a view with parts in section, showing how a junction plate is mounted on base members.

The above disclosed screw-adjustable device 50 can be also used, for example, for forming a base member for supporting a junction plate 2 arranged substantially horizontally with respect to the floor 40 or to any like support, as shown in FIG. 18. In this instance, the horizontal junction plate 2 has its front face turned downwardly, and an adjusting device 50 is arranged co-axially to each one of the coupling hubs 4 of said plate, so as to have its truncated cone-shaped base member 43 resting on the floor 46, and being possibly secured thereto.

For this latter purpose, any suitable anchoring means may be used, such as a known expanding plug 47 which is fitted into a hole 49 in the floor 46, with its screw 48 being passed through the bore 242 in the disc 142 of the threaded bushing 42. The head 148 of said screw 48 bears on the disc 142 of the threaded bushing 42 which is integral with the base member 43, and is accessible through the open end of the said bushing 42 or through the sleeve 44 which is screwed therein. Once the four adjustable spacer devices 50 have been secured as above disclosed to the floor 46, the four coupling hubs 4 in the horizontal junction plate 2 are fastened by means of expanding linking pins 13 to the sleeves 44 of the said devices 50, as shown in FIG. 18. The horizontal junction plate 2 being thus supported and anchored to the floor 45, may form an integral part of any knot consisting of two to six junction plates 2, as above disclosed.

We claim:

1. A modular latticework structure that consists of rods forming any three dimensional framework, and being mutually-connected at structure knots by means of junction plates peripherally provided with inclined flanges at an angle of 45° set in mating relation to be orthogonally joined and connected by means of screws, characterized by the combination of the following features:

(a) each junction plates comprises at least one coupling hub projecting from one face of the plate, perpendicular to a plane thereof, for removably fastening at least one latticework rod to said junction plate;

(b) the flanges in each junction plate are inclined relative to the plane of the plate, toward the plate face from which there projects the said at least one coupling hub;

(c) each of the flanges in each junction plate comprises a free edge formed with a bead projecting from a side of a flange which is turned toward a coupling hub, and extending over at least part of a length of the flange, whereby an enlarged attachment molding is formed between the bead and a corresponding opposite bead in a mating flange of another junction plate;

(d) connecting grippers removably connect the said enlarged attachment molding formed along the outward edge between two orthogonally joined junction plates to at least one latticework rod wherein said connecting gripper has a gripper first end comprising jaws for removably clamping onto said molding, and a gripper second end comprising means for removably fastening onto said at least one latticework rod.

2. The structure according to claim 1, characterized in that each junction plate comprises a plurality of coupling hubs arranged in an angularly equispaced relation around a center of the plate.

3. The structure according to claim 1, characterized in that the bead of each flange in a junction plate has a part-circular profile and is hollow, so that the enlarged attachment molding formed by two mating beads has a substantially circular profile and is hollow.

4. The structure according to claim 1, characterized in that the flanges in a junction plate have at least one slot that coincides with a corresponding slot in a mating flange of another junction plate, wherein said slots are so sized that the jaws of a connecting gripper clamped on the enlarged attachment molding can be fitted into the slots so that an angular movement is allowed of the connecting gripper around the enlarged attachment molding.

5. The structure according to claim 1, characterized in that the screws for fastening together two junction plates are freely threaded from a front face of each plate provided with said at least one coupling hub through a respective bore made in a boss projecting from a rear face of a first junction plate, wherein each screw is screwed down into a respective threaded bore made in an ear provided on an opposite rear face of a second junction plate.

6. The structure according to claim 5, characterized in that each junction plate comprises projecting abutment members on a back face of said plate opposite to the coupling hubs so that mutual alignment and positioning occurs where two junction plates are arranged orthogonally to each other.

7. The structure according to claim 1, characterized in that each junction plate comprises a wide central opening with at least two bores arranged in an angularly equispaced relation around the central opening, and are in communication with said central opening by respective slots extending from a cut rim of each of said at least two bores.

8. The structure according to claim 6, characterized in that the ends of the latticework rods and the coupling hubs projecting from the junction plates are of a tubular shape with the rods connected to the hubs by expanding linking pins partly fitted into a tubular end of a rod and partly into a tubular coupling hub, wherein the pins are radially expandable by means of at least one transversal opening-out screw provided in correspondence with a median collar in each linking pin.

9. The structure according to claim 8, characterized in that each of said expanding linking pins comprises two juxtaposed half-pins with facing inner surfaces having complementary projections and recesses which are interengaged so as to bring about a positive interlocking so as to prevent any relative axial and transversal displacement between the two half-pins.

10. The structure according to claim 9, characterized in that each of said expanding linking pins comprises on either side of its median collar, an annular groove which when a respective linking pin section is expanded, is interlockingly connected with an inwardly projecting annular member on an interior surface of a tubular coupling hub or a tubular end of a latticework rod.

11. The structure according to claim 10, characterized in that the inwardly projecting annular member on the interior surface of a tubular end of a latticework rod or of a tubular coupling hub in a junction plate is formed of two diametrically opposite sectors obtained by a crushing and deforming of the tubular end of the latticework rod where said inwardly projecting annular member extends over an angle smaller than 180°.

12. The structure according to claim 1, characterized in that each connecting gripper comprises two opposing, concavely shaped jaws and at least one clamp screw adapted for clamping the enlarged attachment moding formed at the edge between two junction plates arranged orthogonally to each other, said jaws being provided with juxtaposed complementary linking half-pin extensions which form an expanding linking pin on which the tubular end of a latticework rod is engaged, wherein said linking pin is radially expandable by means of at least one transversal opening-out screw acting between the linking half-pin extensions of the two jaws.

13. The structure according to claim 12, characterized in that a linking half-pin extension, of at least one jaw of the connecting gripper is discrete from the respective at least one jaw and is connected therewith by interlocking means which permit a small relative movement between said at least one jaw and the linking half-pin extension.

14. The structure according to claim 13, characterized in that said at least one jaw of a connecting gripper have juxtaposed shanks between which there acts a clamp screw, and from which there extend the juxtaposed complementary linking half-pin extensions, while the facing inner surfaces of said shanks and of said half-pin extensions are provided with complementary projections and recesses which are interlockingly fitted the one in the other, whereby any relative axial and transversal displacement is prevented between the two opposing, concavely shaped jaws.

15. The structure according to claim 14, characterized in that the two jaws of the connecting gripper are provided with an internal toothing.

16. The structure according to claim 1 characterized in that the at least one latticework rod comprises two parallel latticework rods fastened to a junction plate with at least one anchoring hook engaged with each rod by means of a nut comprising a bushing and a head screwed on a threaded shank of said hook, the threaded shank being screwed into a threaded busing rotatably received in a respective bore in the plate, wherein by tightening the nut, the junction plate is pressed against the latticework rods.

17. The structure according to claim 11, characterized in that each tubular coupling hub is a junction plate has a truncated cone-shaped base portion extending from each coupling hub and being connected to the plate so as to open on the opposite face thereof, the tubular coupling hubs being each also formed with an extension extending at the interior of the respective truncated cone-shaped base portion and opening on the opposite face of the junction plate, and the spacer feet are each engaged in an open end of the internal extension of a tubular coupling hub and in a surrounding open end of the respective truncated cone-shaped base portion.

18. The structure according to claim 15, characterized by Y-shaped connection members consisting each of a sleeve to which two other spaced apart sleeves which are parallel to each other and to the one sleeve, are fixedly connected by means of two diverging limbs, each one of the said sleeves being connectable to the tubular end of a latticework rod by means of an expanding linking pin, or being connectable to an expanding linking pin formed by the two linking half-pin extensions of the two jaws of a connecting gripper.

19. The structure according to claim 1, wherein said structure comprises telescopic rods consisting each of two tubular rods which are slidably telescoped within one another and which are lockable to each other at a predetermined length of a telescopic rod.

20. The structure according to claim 19, characterized in that at least one end of the telescopic rod is provided with a screw-adjustable spacer device.

21. The structure according to claim 1, characterized by adjustable spacer devices consisting each of a truncated cone-shaped base member integral with an internal threaded bushing which is provided at the interior of the truncated cone-shaped base member, each spacer device comprising a small end opening on a small end of said base member, and a large end opposite to said small end of the spacer device extending substantially up to be flush with the large end of the truncated cone-shaped base member, where the threaded bushing is provided with a disc having a central opening therein, a sleeve being screwed in an opposite open end of the threaded bushing, and being provided with an external thread, and projecting axially from the small end of the truncated cone-shaped member, and into the said sleeve there can be inserted an expanding linking pin.

22. The structure according to claim 21, characterized in that the truncated cone-shaped base member can be applied to at least one end of a telescopic rod.

23. The structure according to claim 22, characterized in that a plurality of adjustable spacer devices with the large ends of their truncated cone-shaped base members resting on a support, bear a junction plate which by means of is tubular coupling hubs and with the aid of expanding linking pins is fastened to the sleeves screwed in the internal threaded bushings of the base members by means of the tubular coupling hub, and the base members can be anchored to the support by means, for example, of expanding plugs with their screws being passed through the bores in the discs of the threaded bushings.

24. The structure according to claim 16, wherein spacer feet are positioned between the plate and at least one latticework rod, said spacer feet having a first end shape complementary to a surface of the plate, and a second end shape complementary to a surface of at least one latticework rod.

* * * * *